United States Patent [19]

Watkins

[11] 3,974,966

[45] Aug. 17, 1976

[54] MINIATURE FLAT SPRAY NOZZLE

[75] Inventor: Sidney C. Watkins, Bloomfield, Conn.

[73] Assignee: Avco Corporation, Stratford, Conn.

[22] Filed: Aug. 20, 1975

[21] Appl. No.: 606,164

[52] U.S. Cl. ..... 239/590.3; 239/598

[51] Int. Cl.[2] ..... B05B 1/04

[58] Field of Search ..... 239/553.3, 590.3, 597, 239/598

[56] References Cited

UNITED STATES PATENTS

| | | | |
|---|---|---|---|
| 1,987,962 | 1/1935 | Leupold | 239/590.3 |
| 3,622,080 | 11/1971 | Greenwood | 239/597 X |
| 3,907,210 | 4/1974 | Dow, Jr. et al. | 239/553.3 |

FOREIGN PATENTS OR APPLICATIONS

| | | | |
|---|---|---|---|
| 504,958 | 8/1954 | Canada | 239/590.3 |

*Primary Examiner*—Evon C. Blunk
*Assistant Examiner*—Andres Kashnikow
*Attorney, Agent, or Firm*—Charles M. Hogan; Irwin P. Garfinkle

[57] ABSTRACT

A miniature flat spray nozzle is disclosed which delivers a fan-shaped mist of fuel to a gas turbine combustor from a narrow slot. The slot is formed by making a transverse cut in a fuel-carrying conduit at a location near its end. A specially formed part is inserted into the end of the conduit which, in addition to capping off the conduit, divides the space adjacent thereto into three small chambers. One chamber is immediately below the transverse slot. Four orifices in the bottom wall of this first chamber connect it with the other two chambers. Each of the lower chambers opens into the conduit at its upstream end. Fuel delivered down the conduit divides in two parts, passes through the orifices between the lower and upper chambers, undergoes turbulent mixing in the chamber adjacent the transverse slot, and issues forth from the slot as an atomized mist.

5 Claims, 5 Drawing Figures

MINIATURE FLAT SPRAY NOZZLE

BACKGROUND OF THE INVENTION

This invention relates to improvements in flat spray nozzles used in gas turbine combustors. Of particular concern are nozzles of miniature size and simple configuration which must perform well under a wide range of temperature and fuel viscosity conditions. Many different types of flat spray nozzles have been built for use in gas turbine engines. My previous inventions in the field, as represented by U.S. Pat. Nos. 3,834,627, 3,759,448, 3,713,591, 3,702,175 and 2,878,065, typify the present status of the art. All of the above are more complicated than my miniature flat spray nozzle. Due to its simplicity of design, it has been found particularly useful in conducting combustor research. Spray nozzles fabricated according to the principles of my invention can be easily positioned in a multiplicity of locations when attempting to optimize combustor performance.

SUMMARY OF THE INVENTION

The invention pertains to a miniature flat spray nozzle useful in gas turbine combustors. The nozzle consists of a specially formed metal part which is inserted into the end of a fuel-carrying conduit having a transverse slot made a short distance from the conduit's end. The specially formed part divides the end of the conduit into three chambers. The first chamber, a fuel outlet chamber, is in direct communication with the transverse slot. The other two chambers are fuel supply chambers and are in direct communication with the fuel flow in the conduit and they serve to divide the fuel flow. The two fuel supply chambers each have two orifices which provide for fuel flow from the fuel supply chambers to the fuel outlet chamber, one of the orifices being located upstream and one being located downstream of the slot. Thus, the flow path of fuel from the conduit divides into each of the fuel supply chambers and exits from two holes in each of the fuel supply chambers into the fuel outlet chamber. The fuel flow through the orifices and the subsequent turbulent mixing at the slot edge creates a finely atomized mist of fuel which exits from the slot in a flat spray.

The angular dimensions of the spray are fundamentally controlled by the slot dimensions. The spray quality and small changes to the spray angular dimensions can be controlled by proper positioning of the four orifices, both as a function of their spacing from the edge of the transverse slot and their spacing one from the next.

BRIEF DESCRIPTION OF THE DRAWINGS

Having generally described the nature of the invention and how to assemble it from the two parts of which it is comprised, reference is made to the accompanying drawings, in which.

DESCRIPTION OF THE PREFERRED EMBODIMENT

Figure 2:
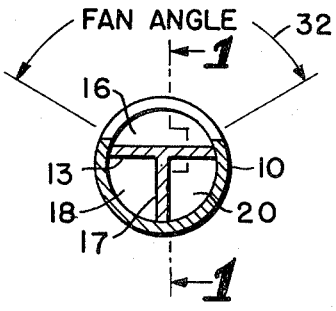
FIG. 2 is a cross-sectional end view of the nozzle taken along line 2—2 of FIG. 1 and showing by line 1—1 the cross-sectional view depicted in FIG. 1.
Figure 1:
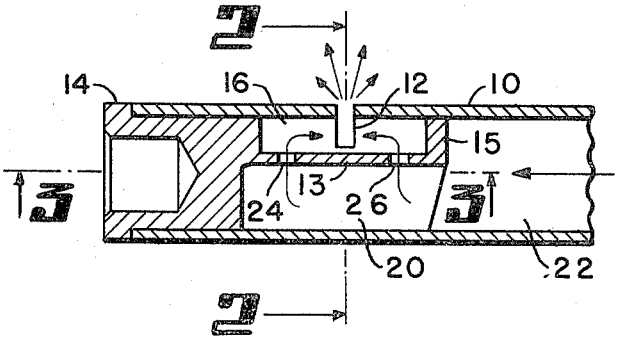
FIG. 1 shows a longitudinal cross section of a nozzle constructed in accordance with the invention.
Figure 3:
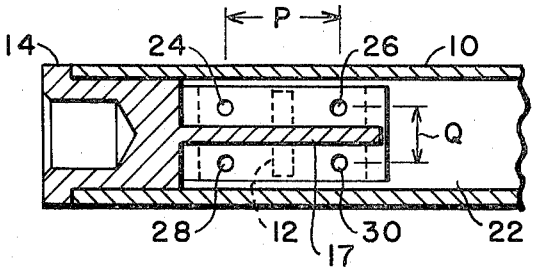
FIG. 3 is a cross-sectional bottom view of the nozzle taken along line 3—3 of FIG. 1.

Referring to FIG. 1, there is shown a fuel conduit 10 having a circular cross section. A transverse slot 12 is cut through a segment of the conduit 10 to provide a fuel outlet a short distance from the downstream end of the conduit. The downstream end of the conduit is closed by means of an insert 14. Insert 14 is pressed into the open end of conduit 10 and may be bonded to it by brazing, welding or any similar means. As seen in FIG. 2, insert 14 divides the space immediately adjacent the end closure into three chambers, supply chamber 18 and 20, plus fuel outlet chamber 16. This is accomplished by providing the upstream end of insert 14 with three separately identifiable parts, as follows: chamber dividing wall 13 which lies in a plane parallel to the axis of conduit 10; chamber separator 15 which closes the upstream end of fuel outlet chamber 16; and structural support member 17 which holds chamber separator 15 in place and also serves as a separator between supply chambers 18 and 20. Chambers 18 and 20 communicate through their open ends with upstream region 22 of the interior of conduit 10. As seen in FIG. 3, orifices 24 and 26 serve as communication ducts between chamber 20 and 16. Orifices 24 and 26 are symmetrically located with respect to slot 12. In a like manner, orifices 28 and 30 allow chamber 18 to communicate with chamber 16. Slot 12 is symmetrically located such that a plane through its center is equidistant from the ends of fuel outlet chamber 16.

Functionally, what we have is as follows: Fuel flowing through the conduit 10 separates into two parts, filling supply chambers 18 and 20. From chambers 18 and 20 the fuel squirts out, respectively, through orifices 28/30 and 24/26. As depicted in FIG. 1, the fine spray of fuel issuing forth from orifices 28 and 30 head for open slot 12 from opposite directions. Molecular collisions and intermixing at the sharp edges of slot 12 create a turbulent condition which results in the spewing forth of a finely atomized mist of fuel from transverse slot 12.

Figure 4:
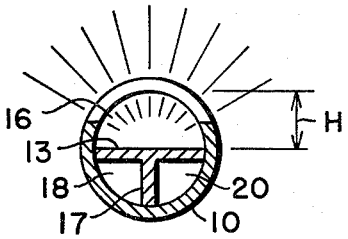
FIG. 4 is a cross-sectional end view taken at the same location as that of FIG. 2, but illustrating that the wall configuration of the inserted part can be proportioned differently to meet design needs.
Figure 5:
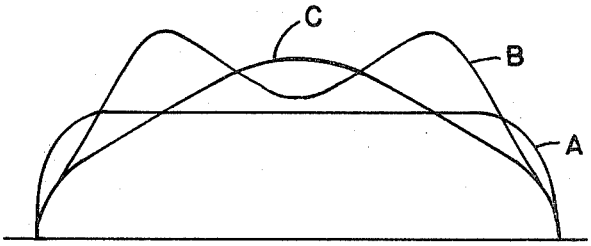
FIG. 5 illustrates the variations in spray pattern distribution characteristics achievable through alternate embodiments of this invention.

There are several variables which control the characteristics of the fuel within fan angle 32 (see FIG. 2). One of these is the placement of the wall between chamber 16 and chambers 18/20. This placement variable is shown as dimension H in FIG. 4. Changing dimension H from the configuration shown in FIG. 2 to that shown in FIG. 4 will narrow the fan angle. Changes in dimension H will also affect another variable, the characteristic distribution of fuel within the spray pattern. This is shown in FIG. 5. However, the characteristic distribution is also affected by the relative placement of orifices 24, 26, 28 and 30. As shown in FIG. 3, separation of the orifices with respect to their distance from the slot is designated spacing P. The relative placement of each pair of orifices is designated spacing Q. Making spacing Q small will provide distribution curve C (FIG. 5). Making Q relatively large will result in a distribution curve more like B. A properly selected combination of H, P and Q will result in the uniform distribution shown in curve A of FIG. 5. The choice of spacing of dimension P will also influence the degree of fuel atomization achieved.

To give insight as to the size of the flow nozzle, it should be pointed out that in the unit reduced to practice, conduit 10 had an inside diameter of approximately 3/16 inch.

The nozzle described above is highly simplified and of miniature size. Insert 14 can be either machined from bar stock or cast. In either case production requires only the simplest of manufacturing techniques. This makes the unit very applicable, both as a tool for doing combustor research and as an operational unit in a low-cost engine.

While an illustrative embodiment of the present invention has been described, it should be apparent to those skilled in the art that other variations may be utilized without departing from the spirit and scope of the invention. For example, the three chambers and transverse slot making up the functioning part of the nozzle might all be machined from a piece of metal having a fitting at one end into which the fuel-carrying conduit was connected. In this way the nozzle could be made to emit a spray, either in line with or normal to the axis of the fuel-carrying conduit.

I claim:

1. A flat spray nozzle assembly comprising:

a cylindrical fluid flow conduit;

means closing the downstream end of said conduit;

a wall lying in a plane parallel to the axis of said conduit, said wall dividing a region of said conduit adjacent said end into a fluid outlet chamber and at least one fluid supply chamber, the upstream end of said fluid supply chamber being open;

means closing the upstream end of said fluid outlet chamber;

a transverse slot through said cylindrical conduit, said slot providing an outlet for said fluid, said slot being equidistant from the ends of said fluid outlet chamber, a chord connecting the ends of said slot being parallel to said plane of said chamber dividing wall; and first and second orifices through said chamber dividing wall, one of said orifices being upstream of said slot, the other being downstream of said slot, said orifices being equidistant from said slot.

2. A nozzle assembly as defined in claim 1 wherein said fluid supply chamber is partitioned by a structural support member resulting in the formation of two fluid supply subchambers, each having an opening at its upstream end which communicates with the interior of said conduit causing the division of the fluid flow into two parts.

3. The nozzle assembly as defined in claim 2 wherein there are four orifices, said orifices being arranged in pairs, the first member of each pair being on one side of said transverse slot and the second member of each pair being spaced an equal distance on the opposite side of said slot, and with one orifice pair set providing communication between said fluid outlet chamber and one of said fluid supply chambers, while the second orifice pair set provides communication between said fluid outlet chamber and the other of said fluid supply chambers.

4. The nozzle assembly as defined in claim 2 wherein said structural support member includes a chamber separator which closes off the upstream end of said fluid outlet chamber.

5. The nozzle assembly as defined in claim 4 wherein said structural support member maintains a fluid seal between said chamber separator and the interior wall of said conduit limiting fluid entrance into said fluid outlet chamber to the supply furnished by said orifices.

* * * * *